US005651573A

United States Patent [19]

Germain

[11] Patent Number: 5,651,573

[45] Date of Patent: Jul. 29, 1997

[54] FLAT SLING COUPLING CONSTRUCTIONS

[76] Inventor: Dennis St. Germain, 358 High Ridge Rd., Chadds Ford, Pa. 19317

[21] Appl. No.: 655,948

[22] Filed: May 31, 1996

[51] Int. Cl.[6] ..... B66C 1/12

[52] U.S. Cl. ..... 294/74; 294/82.11; 24/129 R; 24/698.1

[58] Field of Search ..... 294/74, 82.1, 82.11, 294/82.14; 24/129 R, 115 H, 115 K, 697.2, 698.1, 698.2

[56] References Cited

U.S. PATENT DOCUMENTS

| | | | |
|---|---|---|---|
| 1,490,066 | 4/1924 | Carr | 294/74 |
| 2,293,771 | 8/1942 | Signalness | 24/129 R |
| 3,343,862 | 9/1967 | Holmes | 294/74 |
| 3,743,341 | 7/1973 | Gale | 294/74 |

FOREIGN PATENT DOCUMENTS

| | | | |
|---|---|---|---|
| 3119-859 | 12/1982 | Germany | 294/82.11 |

*Primary Examiner*—Dean Kramer
*Attorney, Agent, or Firm*—Anthony J. McNulty

[57] ABSTRACT

A flexible, flat-plane sling construction for lifting heavy loads which includes a flat-shaped coupler bit-link having a body portion which includes an aperture at one end in which a flat lifting sling slidably passes there through, and an open slot at its other end having a raised arm at the entrance side of the slot, a flat lifting sling which passes first through the aperture, and passes second through a hook or a ring which connects the sling to a load, and third passes over the raised arm of the coupler to connect the lifting sling to the load.

6 Claims, 3 Drawing Sheets

FLAT SLING COUPLING CONSTRUCTIONS

BACKGROUND OF THE INVENTION

History of the Technology

In certain industrial applications, heavy, stiff, bulky metal wire rope slings have been replaced by lighter, flexible, synthetic fiber slings. Roundslings and flat slings are preferred by professional riggers when the particular application permits their use. Conscientious riggers are constantly seeking improved sling constructions so that they can safely govern the movement of their payload by controlling the direction of the vector forces acting on the loads which they are lifting, lowering and pulling. Flat sling constructions in which the individual component members, such as the sling and fittings, lie on the same plane are preferred over irregular, multi-dimensional sling constructions which contain bulky, unmanageable coupling members, such as shackles, turnbuckles and the like, which interfere with a connection of the coupling link, the sling, and the load in the same plane. There has been a need in sling technology for a coupling link which is a single fitting that can be adapted for any uses in connecting different load bearing pieces together in the same relative plane.

The prior art fittings were designed to accommodate wire rope or chain, but not synthetic slings, e.g. web, roundsling, and TWIN-PATH® slings. The flat sling must not be bunched or crimped by the fitting because it loses strength when this happens. It is preferred to present a flat sling with a flat fitting coupler link that is wide enough to support the sling at the sling's greatest width. The prior art fittings did not provide adequate sling bearing surface, they caused the synthetic slings to lose strength where the eye of the payload lifting device was joined to the coupling link. The large, unwieldy prior art fittings also increased the cost of assembly and disassembly of the sling construction.

Discussion of the Prior Art

Over the years, the industrial lifting slings have been heavy metal devices which have used heavy metal chain-type choker hooks, such as described in U.S. Pat. No. 3,984,899. The problem with the use of such large metal hooks is that the sling construction can not be assembled along the same plane because the shape of the fittings are too bulky and require irregular-shaped openings for securing the ends of chains. Even though the technology of slings has evolved to the point where flat profile slings of synthetic material are being used, the fittings for connecting the sling to the load have not followed the same pattern of development.

Another example of a bulky fitting for slings is disclosed in U.S. Pat. No. 3,778,095 which shows a rather bulky implant for a cargo sling having slots open on its top surface to enable a loop of webbing to be engaged in the slot which implant is connected to the terminal block of a crane by means of apertures and slots. Further, U.S. Pat. No. 4,404,712 discloses a sling hook which has another bulky three dimensional profile which hook contains a sleeve portion having a curved slot that permits the installation of a wire rope sling by twisting it onto the sleeve hook. Again, such bulky coupling means interfere with the riggers ability to manage the load while it is being transferred from one place to another.

Another rather bulky fitting used by riggers' for wire rope slings is disclosed in U.S. Pat. No. 4,118,059 which describes a device for clamping wire rope slings in the sleeve of a sling choker which involves sliding the wire rope into the bore of a keyhole section of a coupler, and force fitting a pin into a channel portion of a coupler so that the wire rope is clamped inside the bore. Still further, U.S. Pat. No. 4,789,193 disclosed an end fitting for a lifting sling which has a fitting width at one end which is curved to accommodate a crane hook while the other end is straight so that a web sling can be attached thereto. There is little or no teaching in the prior art which permits a rigger to assemble a flat plane sling construction using a synthetic roundsling connected through a flat coupler bit to a load.

SUMMARY OF THE INVENTION

This invention provides the rigger with a sling construction that is flat and more manageable which makes it easier to control when moving the load from place to place. This invention comprises a coupler fitting which acts as a connecting link between the lifting sling and the load connector, such as a rigger's hook or ring. This coupler bit consists of a flat profile fitting having a body portion which has two ends which includes an aperture at one end having sufficient width to receive the free end of a flat lifting sling slidably passing there through, and an open slot at its other end which has a raised arm at a side entrance to the open slot in which the free end of the sling is connected.

In the construction, the flat lifting sling passes first through the aperture at one end of the coupling link, and then passes through the rigger's connector bearing the load, and finally is secured by connecting the free end of the lifting sling to an arm of the coupler which forms the open slot and which has a sling retention means in the form of a raised arm at the end thereof as described more fully in the drawings. The expressions aperture and closed slot are used interchangeably in describing the drawings.

In another embodiment of this invention two or more identical flat coupler bit means are placed in series in back to back relationship to each other in which each respective raised arm is located on the opposite sides of the construction as shown in FIGS. 4 and 5 of the drawings which provides a retaining hook on each side of the open slot in order to better retain the lifting sling in a terminal secure engagement. In the drawings, a roundsling is used to illustrate how the free end loop of the sling is lifted over the raised hook arm at the side entrance to the open slot and is wrapped around the arm in order to secure the construction.

In an additional embodiment of this invention, the construction may comprise two or more flat lifting slings which are passed through aforesaid aperture of the coupling means in distinct, parallel, side-by-side relationship. This construction requires a wider opening in the aperture, also referred to herein as the closed slot, so that there is no bunching or crimping of the slings which would cause them to loose strength. Still another embodiment of this invention, would involve the use of a series of coupler means in combination with two or more lifting slings passing through the apertures in series.

A flat sling construction may be developed by simply using coupler bits of this invention aligned in series in back-to-back relationship in which their respective raised arm hooks at the side entrance to each open slot face in opposite directions from the arm in series next to it, and then passing a roundsling loop through the apertures or closed slots of the coupling bits and directly around a load, and then securing the end of the free roundsling loop inside the channel formed by the open slots of the coupler bits which are aligned in series. A single path roundsling, or a multiple path roundsling, such as described in St.Germain U.S. Pat. No. 4,850,629, may be used as the flat sling in this invention. This embodiment of the invention is described more fully in FIG. 7 of the drawings.

The coupler means of this invention is used as a bit in a bridle construction to join two other component pieces of the construction. This coupler means has a body portion with two opposite ends which comprises a closed eye slot or aperture at one end which provides sufficient bearing surface for the lifting sling to be received therein, and an open slot at the opposite end which has at the side entrance to the open slot a raised retaining arm which serves as a hook to prevent the lifting sling from disengaging from the construction. This coupling means connects a first piece which is the lifting sling to a second piece which is the load connector means such as a rigger's hook or a rigger's ring. As shown in the accompanying drawings, the free end of loop of the lifting sling is passed through the aperture of the coupling device and then is passed through the eye of the rigger's load connecting means in which the coupler forms a bight to connect the sling to the load.

The coupling means used to form the sling construction of this invention permit the rigger to use lighter fittings which produce flat plane sling constructions, and makes it easier for the rigger to lift and transport the load. The lifting slings used in this invention can be formed of natural or synthetic fiber material, such as polyester, polyethylene, Dacron, Kevlar®, Spectra®, and suchlike. Since the coupling device of this invention may be used in combinations in series, it permits the rigger to construct a more flexible assembly. For example, a coupling bit link of this invention that will support one thousand pounds of load can be used individually for loads up to one thousand pounds, or in combination with other identical coupling means having the same rated load capacity to lift heavier loads; for example, the rigger could combine five coupling links each rated at one thousand pound rated capacity to lift a load of five thousand pounds. This permits quick and easy installation or disassembly of the sling construction. The rigger may use the flat coupler bit means of this invention in a bridle construction piece which joins a length of the secured sling component of the construction at its bight, or slack point of its loop, to a connector opening of a second component which is under load and which may be selected from a member of the group consisting of a lifting hook, lifting ring, second coupler means, a second flat lifting sling, or other load-bearing means, or the sling may be joined in direct connection to a load mass in choker configuration.

When the sling is configured in a choker assembly, it is preferred that more than one coupler means be used in series as described above. When multiple coupler fittings are used, it provides the rigger with extra strength and gives the rigger more flexibility so that instead of using a large, bulky, single fitting with the highest rated load capacity, the same result can be achieved by using multiple fittings of smaller size. This also permits the rigger to avoid building the coupling fitting into the sling itself which reduces the flexibility of the construction.

Figure 1:
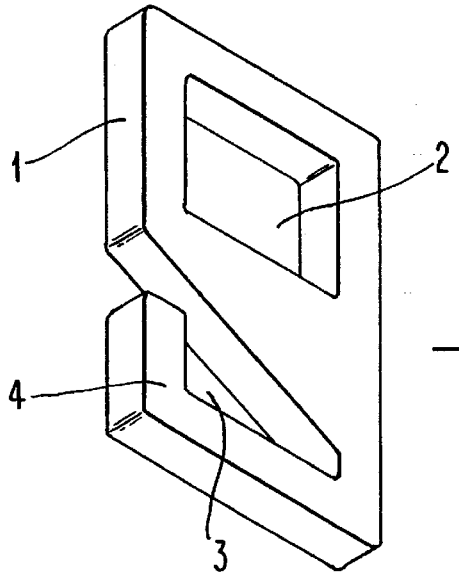
FIG. 1 is a perspective view of the flat coupler bit-link means (1) of this invention which comprises a body having a flat rectangular aperture or opening which is a closed slot (2) at one end, and an open slot (3) having a raised arm (4) at the other end.
Figure 2:
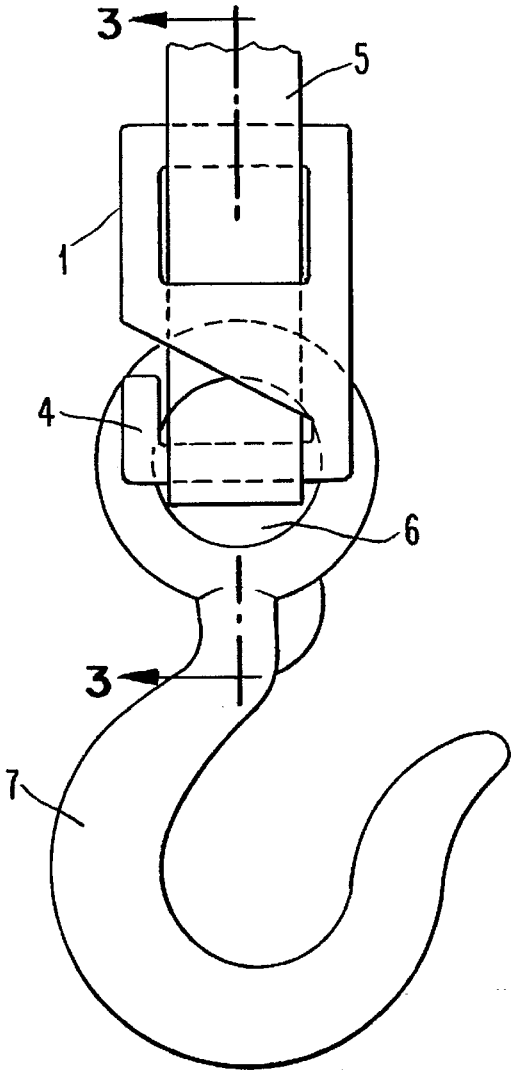
FIG. 2 is a plane view of a flat sling construction under load in which the coupler of FIG. 1 joins two other pieces which comprises the coupler (1), a roundsling loop (5) first piece which passes through the coupler's closed slot (2) as shown in FIG. 1 at one end, and passing through the eye (6) of a rigger's lifting hook (7) second piece, in which the sling loop (5) is connected to the raised arm hook (4) at the coupler's open slot, (3) as shown in FIG. 1, at its opposite end.
Figure 3:
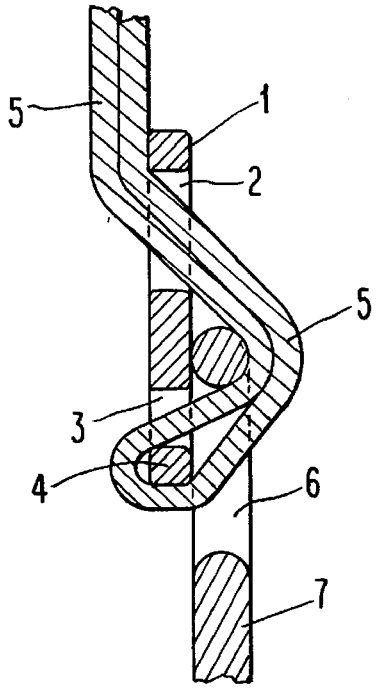
FIG. 3 is a cross-section view of the flat construction in FIG. 2 along line 3—3 which shows the round sling loop (5) under load passing through the closed slot (2) of the coupler (1), and passing through the eye (6) of the hook (7) under load, and passing through the open slot (3) and connected to the arm (4) of the coupler at the open slot at its opposite end.
Figure 4:
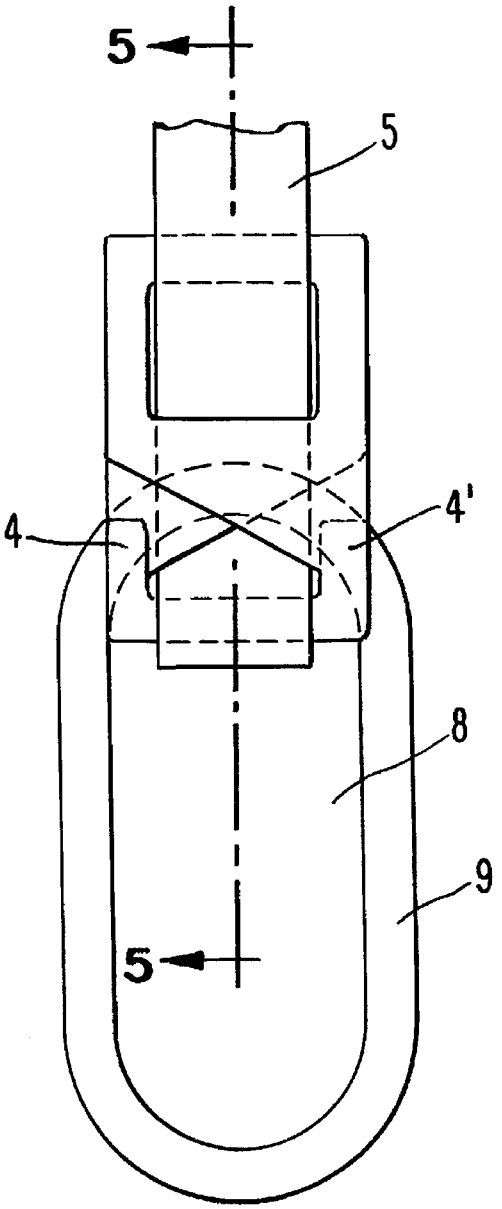
FIG. 4 is a plane view of a flat coupler link sling construction under load which comprises two coupler bits which are placed back-to-back so that they face in the opposite direction from each other with their respective raised arm hooks (4 and $4^1$) located on opposite sides of the construction which further comprises, a roundsling loop (5) first piece which passes through the closed slots, (2) as shown in FIG. 1, at the first ends of the two back-to-back couplers (1 and $1^1$ as shown in FIG. 1), and through the opening (8) of a rigger's lifting ring (9) second piece, in which the sling loop (5) is connected to the raised arm hooks (4 and $4^1$) at the couplers' open slots, (3 and $3^1$) as shown in FIG. 5, at their opposite ends.
Figure 5:
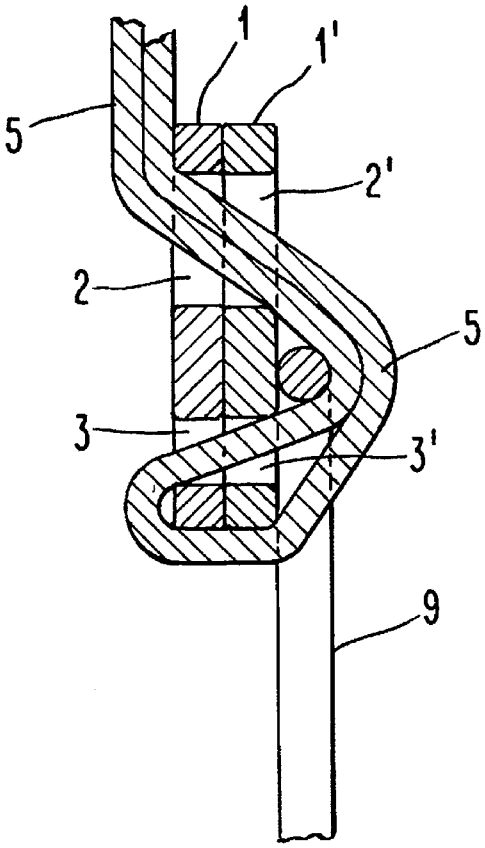
FIG. 5 is a cross-section view of the flat construction in FIG. 4 along line 5—5 which shows the round sling loop (5) under load passing through the closed slots (2 and $2^1$) of the couplers (1 and $1^1$), and passing through the opening (8) of the ring (9) under load, and passing through the open slots (3 and $3^1$) and connected to the opposite facing arms (4 and $4^1$) of the back-to-back couplers at their opposite open slot ends.
Figure 6:
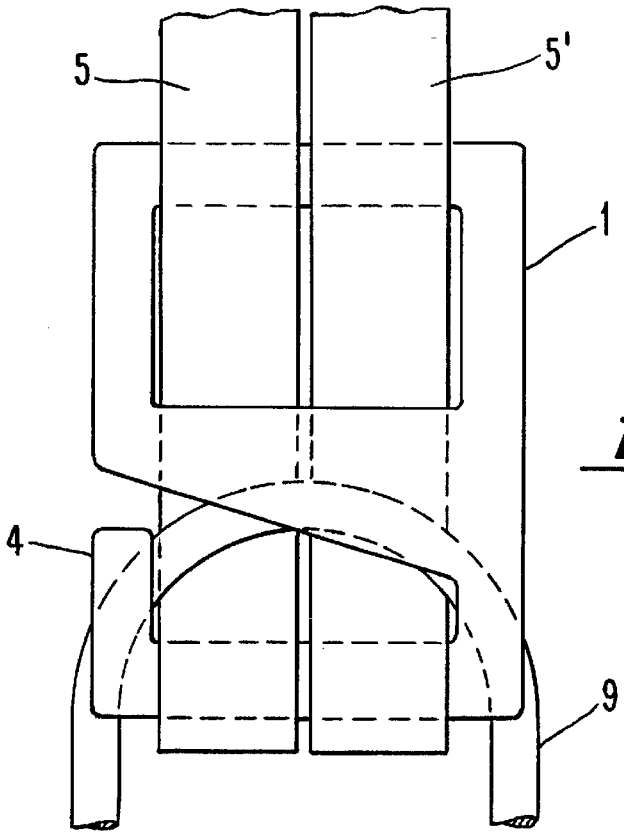
FIG. 6 is a plane view of a flat sling construction under load in which two roundsling loops (5 AND $5^1$) are engaged in distinct parallel side-by-side in a two-leg bridle which comprises a coupler of FIG. 1 which has sufficient widths to accommodate the combined width of slings 5 and $5^1$ which both pass through the coupler's closed slot, (2) as shown in FIG. 1, at its first end, and pass through the opening, (8) as shown in FIG. 4, of a rigger's lifting ring (9), in which the sling loops (5 and $5^1$) are connected to the raised arm hook (4) at the coupler's open slot, (3) as shown in FIG. 1, at its opposite end.
Figure 7:
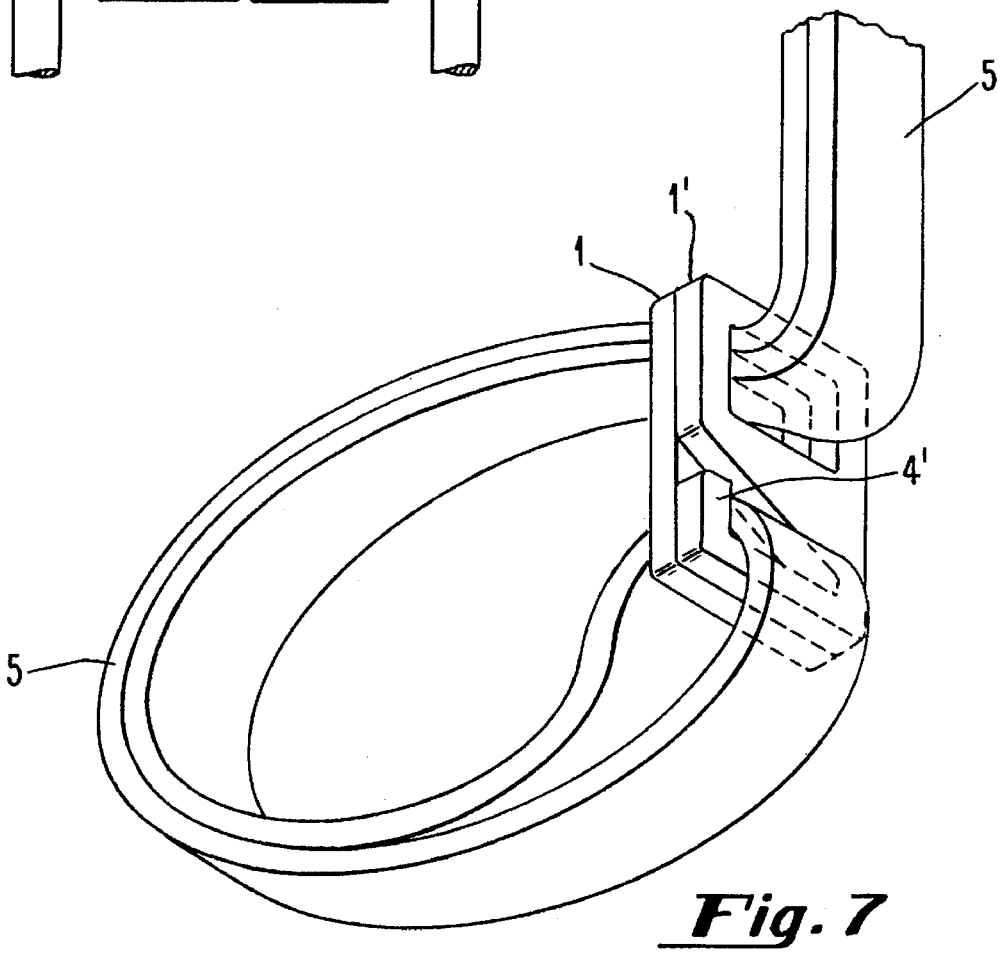
FIG. 7 is a perspective view of a flat sling construction used in a sliding choker hitch which comprises two coupler bits (1 and $1^1$) in the same back-to-back configuration in which their respective raised arm hooks, (4 and $4^1$) as shown in FIG. 4, face in opposite directions from each other, in which a roundsling loop (5) passes through the closed slots at the couplers first ends, (2 and $2^1$) as shown in FIG. 5, and is connected to the couplers' opposite facing arms, (4 and $4^1$) as shown in FIG. 4, at their open slot ends.

A variety of sling constructions can make use of the coupler bit link fitting disclosed herein to obtain a manageable flat-plane assembly. A skilled artisan may be able to use this disclosure to rig slings which are not specifically described herein yet still be within the scope of the following claims which define this invention.

What is claimed is:

1. A flat, plane flexible load-bearing construction which comprises two or more identical flat coupler means each having body portions and having two opposite ends which includes an aperture at one end having sufficient width to receive a flat lifting sling slidably passing there through, and an open slot at the other end having a raised arm at its entrance side, in which each coupler means is in back-to-back relation and their respective raised arms are positioned on the opposite sides from each other, in which each aperture of each said coupler means is aligned in serial connection with the other, a flat lifting sling which passes first through said series of apertures, and passes second through an opening for a load connector means, and third its free end connects to said raised arms and retains in said open slots.

2. The construction of claim 1 in which two or more flat lifting slings in distinct parallel side by side relationship are passed through said coupler means and said load connector means.

3. The construction of claim 1 in which said lifting sling is a multiple path roundsling.

4. A flat, plane flexible load-bearing construction which comprises two or more identical flat coupler means each having body portions and having two opposite ends which includes an aperture at one end having sufficient width to receive two or more flat lifting slings slidably passing there through, and an open slot at the other end having a raised arm at its entrance side, in which each coupler means is in back-to-back relation and their respective raised arms are positioned on the opposite sides from each other, in which each aperture of each said coupler means is aligned in serial connection with the other, two or more flat lifting slings which pass first through said series of apertures, and pass second through an opening for a load connector means, and third their free ends connect to said raised arms and retains in said open slots.

5. The construction of claim 4 in which said lifting slings are multiple path roundslings.

6. A flat plane, flexible load-bearing construction which comprises a flat coupler means having a body portion with two opposite ends which includes an aperture at one end having sufficient width to receive two or more flat lifting slings in distinct parallel side by side relationship slidably passing there through, and an open slot at the other end having a raised arm at its entrance side, two flat lifting slings in distinct parallel side by side relationship which pass first through said aperture, and pass second through an opening for a load connector means, and third the free ends of said parallel slings connect to said raised arm and retain in said open slot.

* * * * *